US009194107B2

(12) United States Patent
Andruch, III et al.

(10) Patent No.: US 9,194,107 B2
(45) Date of Patent: Nov. 24, 2015

(54) REGENERATIVE HYDRAULIC SYSTEMS AND METHODS OF USE

(75) Inventors: John Andruch, III, Lake Village, IN (US); John H. Lumkes, Jr., Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 878 days.

(21) Appl. No.: 13/498,769

(22) PCT Filed: Sep. 29, 2010

(86) PCT No.: PCT/US2010/050716

§ 371 (c)(1),
(2), (4) Date: Jun. 7, 2012

(87) PCT Pub. No.: WO2011/041410

PCT Pub. Date: Apr. 7, 2011

(65) Prior Publication Data

US 2012/0233997 A1 Sep. 20, 2012

Related U.S. Application Data

(60) Provisional application No. 61/246,551, filed on Sep. 29, 2009.

(51) Int. Cl.
*F15B 11/17* (2006.01)
*E02F 9/22* (2006.01)

(52) U.S. Cl.
CPC ..... *E02F 9/2217* (2013.01); *E02F 9/2221* (2013.01); *E02F 9/2239* (2013.01); *F15B 11/17* (2013.01); *F15B 2211/20561* (2013.01); *F15B 2211/20576* (2013.01);

(Continued)

(58) Field of Classification Search
CPC ..... F15B 2211/31547; F15B 2211/30595
See application file for complete search history.

(56) References Cited

U.S. PATENT DOCUMENTS 4,476,679 A * 10/1984 Sato ..... 60/434
5,329,767 A 7/1994 Hewett (Continued)

FOREIGN PATENT DOCUMENTS

DE 10303360 8/2004
JP 2000-319941 11/2000

(Continued)

OTHER PUBLICATIONS

J. Andruch and J. Lumkes, "A Hydraulic System Topography with Integrated Energy Recovery and Reconfigurable Flow Paths Using High Speed Valves", Proceedings of the 51st National Conference on Fluid Power (NCFP), NCFP 108-24.1, 649-657 (Mar. 2008).

(Continued)

*Primary Examiner* — F. Daniel Lopez
(74) *Attorney, Agent, or Firm* — Hartman Global IP Law; Gary M. Hartman; Michael D. Winter

(57) ABSTRACT

Hydraulic systems and methods for using such systems in a variety of machinery, including but not limited to machines having multiple functions performed by one or more hydraulic circuits. The systems enable valves and actuators within the systems to reconfigure themselves so that flow from assistive loads on one or more actuators can be used to move one or more other actuators subjected to a resistive load.

8 Claims, 8 Drawing Sheets

(52) U.S. Cl.
CPC *F15B 2211/214* (2013.01); *F15B 2211/30565* (2013.01); *F15B 2211/30595* (2013.01); *F15B 2211/3138* (2013.01); *F15B 2211/31547* (2013.01); *F15B 2211/41545* (2013.01); *F15B 2211/71* (2013.01); *F15B 2211/761* (2013.01); *F15B 2211/88* (2013.01)

(56) References Cited

U.S. PATENT DOCUMENTS

| | | | | |
|---|---|---|---|---|
| 6,244,048 | B1 * | 6/2001 | Tanaka et al. | 60/421 |
| 6,378,301 | B2 * | 4/2002 | Endo et al. | 60/414 |
| 6,502,393 | B1 * | 1/2003 | Stephenson et al. | 60/414 |
| 7,356,991 | B2 | 4/2008 | Kim et al. | |
| 7,543,449 | B2 | 6/2009 | Ivantysynova et al. | |

FOREIGN PATENT DOCUMENTS

| | | |
|---|---|---|
| JP | 2002-089505 | 3/2002 |
| JP | 2006-123573 | 5/2006 |
| KR | 10-2004-0027090 | 4/2004 |
| WO | 2008009950 | 1/2008 |

OTHER PUBLICATIONS

Joshua D. Zimmerman and Monika Ivantysynova, "The Effect of System Pressure Level on the Energy Consumption of Displacement Controlled Actuator Systems", Proc. of the 5th FPNI PhD Symposium, Cracow, Poland, 77-92 (2008).

Christopher Williamson, Joshua Zimmerman, Monika Ivantysynova, "Efficiency Study of an Excavator Hydraulic System Based on Displacement-Controlled Actuators", Bath ASME Symposium on Fluid Power and Motion Control (FPMC2008), 291-307 (2008).

* cited by examiner

REGENERATIVE HYDRAULIC SYSTEMS AND METHODS OF USE

CROSS REFERENCE TO RELATED APPLICATIONS

This application claims the benefit of U.S. Provisional Application No. 61/246,551, filed Sep. 29, 2009, the contents of which are incorporated herein by reference.

BACKGROUND OF THE INVENTION

The present invention generally relates to hydraulic systems of the types used in machinery, including but not limited to machines having multiple functions performed by one or more hydraulic circuits. More particularly, this invention relates to hydraulic systems that contain one or more positive displacement units capable of operating as pumps and motors, and distributed valve systems that, in combination with the positive displacement unit(s), can be used to control multiple actuators of multi-function machinery.

Compact excavators, wheel loaders and skid-steer loaders are examples of multi-function machines whose operations involve controlling movements of various implements of the machines. FIG. 1 illustrates a compact excavator 100 as having a cab 101 mounted on top of an undercarriage 102 via a swing bearing (not shown) or other suitable device. The undercarriage 102 includes tracks 103 and associated drive components, such as drive sprockets, rollers, idlers, etc. The excavator 100 is further equipped with a blade 104 and an articulating mechanical arm 105 comprising a boom 106, a stick 107, and an attachment 108 represented as a bucket, though it should be understood that a variety of different attachments could be mounted to the arm 105. The functions of the excavator 100 include the motions of the boom 106, stick 107 and bucket 108, the offset of the arm 105 during excavation operations with the bucket 108, the motion of the blade 104 during grading operations, the swing motion for rotating the cab 101, and the left and right travel motions of the tracks 103 during movement of the excavator 100. In the case of a compact excavator 100 of the type represented in FIG. 1, the blade 104, boom 106, stick 107, bucket 108 and offset functions are typically powered with linear actuators, represented as hydraulic cylinders 109 through 114 in FIG. 1, while the travel and swing functions are typically powered with rotary hydraulic motors (not shown in FIG. 1).

On conventional excavators, the control of these functions is accomplished by means of directional control valves. However, throttling flow through control valves is known to waste energy. In some current machines, the rotary functions (rotary hydraulic drive motors for the tracks 103 and rotary hydraulic swing motor for the cabin 101) are realized using displacement control (DC) systems, which notably exhibit lower power losses and allow energy recovery. In contrast, the position and velocity of the linear actuators 109-114 for the blade 104, boom 106, stick 107, bucket 108, and offset functions typically remain controlled with directional control valves. It is also possible to control linear hydraulic actuators directly with hydraulic pumps. Several pump-controlled configurations are known, using both constant and variable displacement pumps. Displacement control of linear actuators with single rod cylinders has been described in U.S. Pat. No. 5,329,767, DE000010303360A1, EP000001588057A1 and WO 2004/067969, and offers the possibility of large reductions in energy requirements for hydraulic actuation systems. Other aspects of using displacement control systems can be better appreciated from further reference to Zimmerman et al., "The Effect of System Pressure Level on the Energy Consumption of Displacement Controlled Actuator Systems," Proc. of the 5th FPNI PhD Symposium, Cracow, Poland, 77-92 (2008), and Williamson et al., "Efficiency Study of an Excavator Hydraulic System Based on Displacement-Controlled Actuators," Bath ASME Symposium on Fluid Power and Motion Control (FPMC2008), 291-307 (2008).

Various efforts have examined the use of integrated valve systems to improve the performance of hydraulic systems, including hydraulic systems of types that can be adapted for use in the excavator 100 of FIG. 1. For example, J. Andruch and J. Lumkes, "A Hydraulic System Topography with Integrated Energy Recover and Reconfigurable Flow Paths Using High Speed Valves," Proceedings of the 51$^{st}$ National Conference on Fluid Power (NCFP), NCFP 108-24.1, 649-657 (March 2008), reports research that was conducted to explore how digital valves can be used to recapture energy when connected as a network of valves and actuators with a single pump. This system, designated a "topography with integrated energy recovery," or TIER™ system, is schematically represented with reference numeral 10 in FIG. 2. The system 10 is represented as comprising a pair of hydraulic actuators 12 and 14, a prime mover (motor) 16, a fixed displacement pump 18 (operating only in a pumping mode), and four sets 20, 22, 24 and 26 of electronically-operated on/off valves. Each valve set 20, 22, 24 and 26 is connected to one of the ports of the actuators 12 and 14. A high pressure conduit system 28 fluidically connects the pump 18 to a first valve of each set 20, 22, 24 and 26. Furthermore, a low pressure conduit system 30 fluidically connects a reservoir 38 to a second valve of each set 20, 22, 24 and 26. A particular aspect of the system 10 is the inclusion of a third conduit system 32, referred to as a secondary pressure rail (SPR), that enables the ports of each actuator 12 and 14 to be fluidically connected to either the high or low pressure conduit system 28 or 30. These connections to the third conduit system 32 are controlled through the operation of a pair of valves 34 and 36.

The TIER™ system 10 represented in FIG. 2 can be operated in a manner similar to an electrical system neural network that has been adapted to hydraulic systems. As known in the art, neural network controllers are able to adapt and learn, or be trained, during operation. In combination with an appropriate electronic control system, the TIER™ system is capable of similar behavior by enabling two or more hydraulic actuators (such as the actuators 12 and 14) to reconfigure themselves, in other words, to sum flows from multiple changing sources, isolate faulty fluid conduit sections, and adaptively change operating modes (load sensing, IMV, displacement control, and modes unique to the TIER™ system). The system 10 can operate similarly to an independent metering valve (IMV), while also offering the ability to perform flow regeneration on linear actuators with different piston areas. As known in the art, flow regeneration refers to the situation in which both sides of a piston within a hydraulic cylinder are exposed to the same pressure, such that the effective area of the cylinder is the cross-sectional area of the piston rod. Flow regeneration enables increased actuating speeds because the flow required to extend the cylinder is only the change in volume of the piston rod within the cylinder.

In addition to traditional flow regeneration, the TIER™ system 10 is able to provide flow regeneration between two or more actuators within the system 10 through the use of the third conduit system (SPR) 32, which enables the system 10 to transfer flow from an assistive load to a resistive load. As used herein, the term "assistive load" refers to operating conditions in which the desired movement of a hydraulic actuator and the load applied to the actuator are in the same direction, for example, when a hydraulic actuator (cylinder) is lowering a large mass. In contrast, "resistive load" is used herein to denote conditions in which the external load applied to an actuator opposes the desired motion of the actuator, for example, when a hydraulic actuator is raising a load. In a conventional hydraulic system, as the articulating arm 105 is lowered the pressure within the side of the cylinder 109 opposite the piston rod would simply be throttled through a valve before being returned to the reservoir 38, leading to energy loss. In contrast, the TIER™ system 10 enables this high pressure fluid to flow to another actuator, for example, one of the other actuators 110-114 in which the high pressure flow from the cylinder 109 can be used to assist the operation of the other cylinder 110-114. When pressure/flow relationships of two or more actuators allow for regeneration, the SPR 32 of FIG. 2 can be used to recover energy and improve the cycle efficiency, for example, by about 33% compared to using industry standard spool valves in pressure-compensated load sensing systems.

Other configurations of hydraulic systems have been proposed to provide similar capabilities, for example, in WO 2008/009950, which discloses a digital pump/motor unit capable of both pumping and motoring with a system of digital valves.

Notwithstanding the above advancements, further improvements in hydraulic systems are desired, particularly for the purpose of realizing high performance energy-efficient hydraulic systems.

BRIEF DESCRIPTION OF THE INVENTION

The present invention provides hydraulic systems and methods for using such systems in a variety of machinery, including but not limited to machines having multiple functions performed by one or more hydraulic circuits.

According to a first aspect of the invention, a hydraulic system includes at least first and second hydraulic actuators, multiple sets of hydraulic valves fluidically connected to the first and second hydraulic actuators, at least first and second positive displacement units having pumping and motoring modes, and each of the first and second positive displacement units being selectively fluidically connectable to the first and second hydraulic actuators through the sets of hydraulic valves. Drive shafts associated with the first and second positive displacement units are interconnected with each other such that the drive shafts are rotatably coupled and cause the first and second positive displacement units to operate in unison. At least one motor is connected to the drive shafts of the positive displacement units for rotating the drive shafts. A reservoir is provided from which the fluid can be drawn by the first and second positive displacement units when operating in their pumping modes and to which the fluid can be returned by the first and second positive displacement units when operating in their motoring modes. A first conduit system contains at least a first hydraulic valve of each of the sets of hydraulic valves for selectively fluidically connecting the first positive displacement unit to either or both of the first and second hydraulic actuators. The first conduit system continuously fluidically connects the first hydraulic valves. A second conduit system contains at least a second hydraulic valve of each of the sets of hydraulic valves for selectively fluidically connecting the first and second hydraulic actuators to the reservoir. The second conduit system continuously fluidically connects the second hydraulic valves. A third conduit system contains at least a third hydraulic valve of each of the sets of hydraulic valves for selectively fluidically connecting the second positive displacement unit to either or both of the first and second hydraulic actuators. The third conduit system continuously fluidically connects the third hydraulic valves and is adapted to transfer the fluid between the first and second hydraulic actuators. A first valve means is provided for selectively fluidically isolating the first conduit system from the third conduit system and selectively fluidically connecting the first conduit system to the third conduit system. A second valve means is provided for selectively fluidically isolating the second conduit system from the third conduit system and selectively fluidically connecting the second conduit system to the third conduit system. According to preferred aspects of the embodiment, the hydraulic system is operable to: supplement a resistive load generated by the fluid within one of the first and second hydraulic actuators with an assistive load generated by the fluid in the other of the first and second hydraulic actuators by transferring the fluid within the other of the first and second hydraulic actuators to the one of the first and second hydraulic actuators through the third conduit system; supplement the resistive load generated by the fluid within the one of the first and second hydraulic actuators by transferring the fluid from the reservoir to the one of the first and second hydraulic actuators through the third conduit system while operating the second positive displacement unit in the pumping mode thereof; and recover energy by transferring the fluid within the other of the first and second hydraulic actuators to the reservoir through the third conduit system while operating the second positive displacement unit in the motoring mode thereof.

According to a second aspect of the invention, a method of using the hydraulic system described above includes installing the system on machinery and moving implements of the machinery with at least the first and second hydraulic actuators. Still other aspects of the invention entail the use of a hydraulic transformer fluidically connected to the first and third conduit systems to enable the exchange of pressure and flow at different levels. The use of the transformer may allow for the elimination of the second positive displacement units and potentially other elements of the hydraulic system described above.

A significant advantage of this invention is the ability to use and operate the hydraulic systems to achieve better energy efficiency, reliability, and performance. The systems enable valves and actuators within the systems to reconfigure themselves so that flow from assistive loads on one or more actuators can be used to move one or more other actuators subjected to a resistive load. Various implementations of these systems are possible, including the use of multiple valves with either a single or multiple positive displacement units. If multiple positive displacement units are used, units having different displacements can be employed and selectively operated to minimize their operation at low displacements, thus increasing overall system efficiency. Other variations include configurations that allow open-loop or closed-loop positive displacement units to be used, the use of fixed displacement units, and/or the ability to store energy in one or more accumulators. Finally, the system can be employed in a wide variety of applications, nonlimiting examples of which include excavators, feller-bunchers and aerospace flight control systems.

Other aspects and advantages of this invention will be better appreciated from the following detailed description.

DETAILED DESCRIPTION OF THE INVENTION

The present invention provides hydraulic systems capable of controlling the operation of multiple actuators, particular examples of which are linear and rotary actuators. The hydraulic systems contain distributed valve systems and one or more positive displacement units having both pumping and motoring modes. The valve systems and positive displacement units are connected with conduit systems in a manner that enables the hydraulic systems to be operated with enhanced energy efficiency, reliability, and performance.

Figure 2:
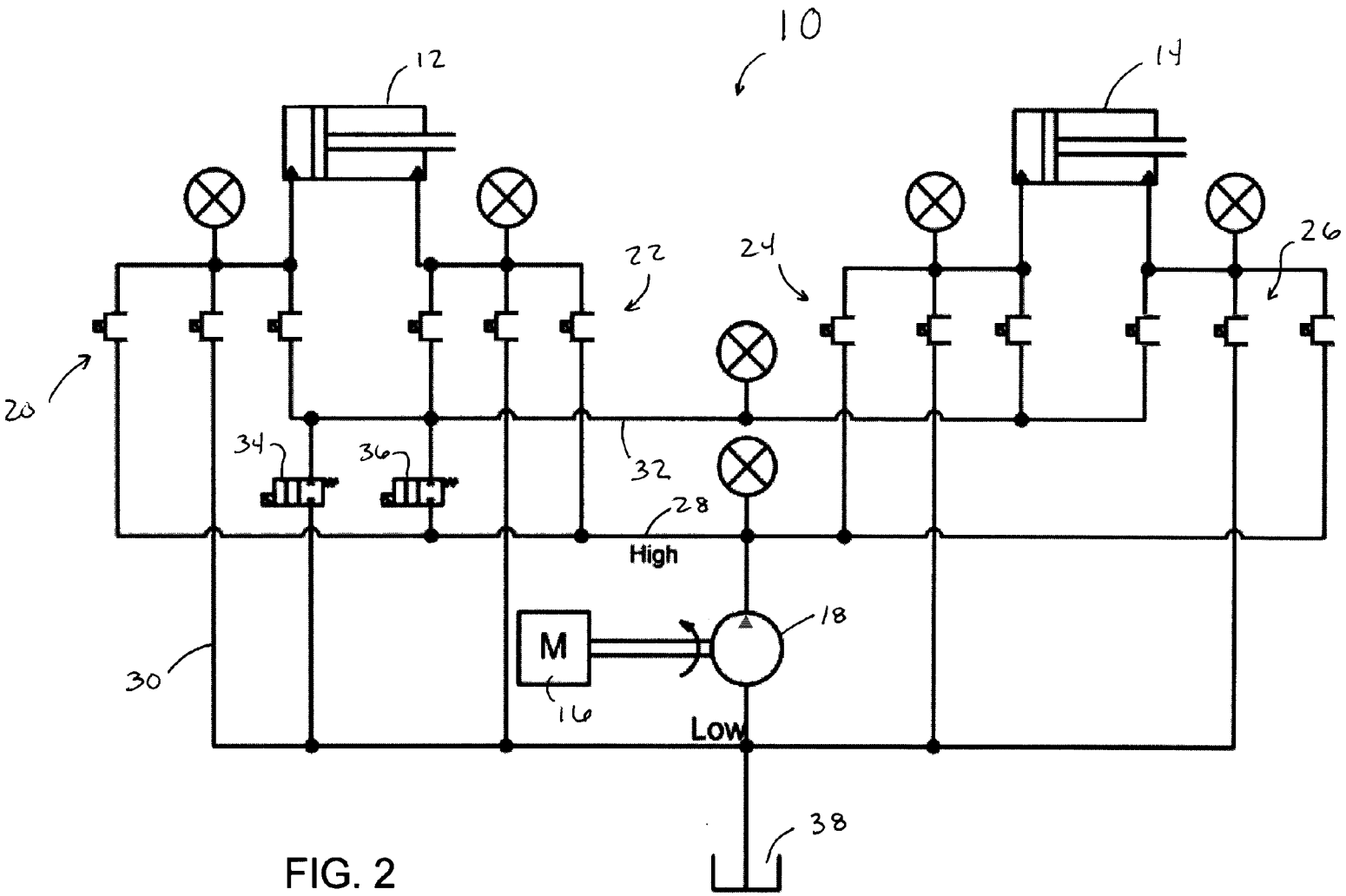
FIG. 2 (Prior Art)
FIG. 2 schematically represents a hydraulic system of a type known in the prior art.
Figure 3:
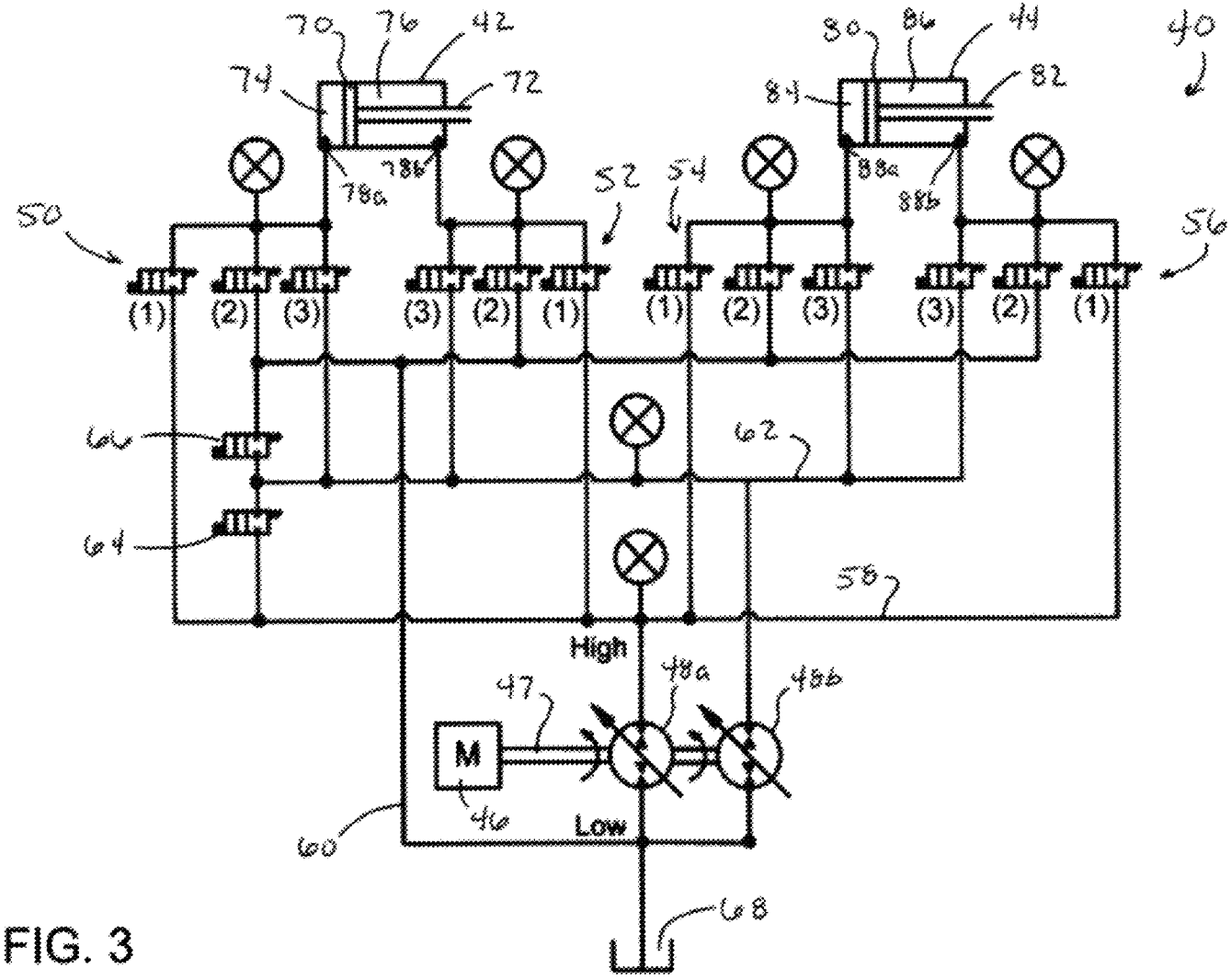
FIG. 3 schematically represents a hydraulic system configured to have an energy recovery capability in accordance with a first embodiment of the present invention.

A hydraulic system 40 according to a first embodiment of the invention is represented in FIG. 3. Similar to the TIER™ system 10 of FIG. 2, the system 40 of FIG. 3 is schematically represented as comprising a pair of hydraulic linear actuators 42 and 44, a prime mover (motor) 46, first and second positive displacement units 48*a* and 48*b*, and four sets 50, 52, 54 and 56 of valves. The schematic represented in FIG. 3 is intended to indicate the very basic operating components of the system 40. Therefore, it should be understood that the system 40 may contain additional components, nonlimiting examples being energy storage units such as one or more accumulators, and yet perform in the manner as will be described below.

The prime mover 46 can be of any suitable type capable of producing a rotary output for driving the displacement units 48*a* and 48*b*. The units 48*a* and 48*b* are schematically represented as variable displacement and having both pumping and motoring modes. The units 48*a* and 48*b* may be open-loop or closed-loop units. Furthermore, the use of fixed displacement units is also within the scope of the invention. The units 48*a* and 48*b* are further represented as sharing the same input shaft 47 so that both units 48*a* and 48*b* operate at the same rotational speed, though it is foreseeable that the units 48*a* and 48*b* could be connected through a clutch and/or a transmission so that the units 48*a* and 48*b* can be decoupled and/or operate at different rotational speeds. In any event, typical operation is for the units 48*a* and 48*b* to operate in unison, meaning that operation of the prime mover 46 causes both units 48*a* and 48*b* to rotate. Both units 48*a* and 48*b* are represented as drawing fluid from the same reservoir 68, though other configurations are within the scope of the invention.

Each actuator 42 and 44 is represented in FIG. 3 as a linear actuator, though either could be replaced by another type of actuator, for example, a rotary actuator. As linear actuators, each actuator 42 and 44 is represented as having a cylinder containing a piston 70 or 80, a piston rod 72 or 82 that extends from the cylinder, and two chambers 74 and 76 or 84 and 86 separated by the piston 70 or 80. The actuators 42 and 44 are double-acting, with ports 78*a* and 78*b* fluidically connected to the cylinder chambers 74 and 76, respectively, of the actuator 42, and ports 88*a* and 88*b* fluidically connected to the cylinder chambers 84 and 86, respectively, of the actuator 44. The actuators 42 and 44 may be adapted to move a wide variety of equipment, nonlimiting examples of which are any two or more of the implements of the excavator 100 represented in FIG. 1.

The valves of the valve sets 50, 52, 54 and 56 can be of any suitable design. As schematically represented in FIG. 3, each valve set 50, 52, 54 and 56 contains three solenoid-operated two-position two-way directional control valves capable of being independently electronically controlled with a control system (not shown) to selectively prevent or permit flow through the valves. The valves of the valve sets 50 and 52 are connected to the ports 78*a* and 78*b*, respectively, of the actuator 42, and the valves of the valve sets 54 and 56 are connected to the ports 88*a* and 88*b*, respectively, of the actuator 44.

A high pressure conduit system 58 fluidically connects the first displacement unit 48*a* to a first valve (1) of each valve set 50, 52, 54 and 56, through which high pressure fluid from the first displacement unit 48*a* can be selectively delivered to the ports 78*a*, 78*b*, 88*a* and/or 88*b* of the actuators 42 and/or 44. Furthermore, a low pressure conduit system 60 fluidically connects the reservoir 68 to a second valve (2) of each set 50, 52, 54 and 56 of valves, through which low pressure fluid from one or more of the ports 78*a*, 78*b*, 88*a* and 88*b* of the actuators 42 and/or 44 can be selective delivered to the reservoir 68. As with the TIER™ system 10 of FIG. 2, the system 40 further includes a third conduit system 62 that, similar to the secondary pressure rail (SPR) 32 of FIG. 2, can be used to fluidically connect any of the ports 78*a*, 78*b*, 88*a* and/or 88*b* of the actuators 42 and/or 44 to either the high or low pressure conduit system 58 or 60. These connections to the third conduit system 62 are controlled through the operation of a pair of valves 64 and 66, which are represented in FIG. 3 as solenoid-operated two-position two-way directional control valves capable of being independently electronically controlled to selectively prevent or permit flow therethrough.

Contrary to the TIER™ system 10 of FIG. 2, the third conduit system 62 fluidically connects the second displacement unit 48*b* to a third valve (3) of each set 50, 52, 54 and 56, through which fluid from the second displacement unit 48*b* can be selectively delivered to the ports 78*a*, 78*b*, 88*a* and/or 88*b* of the actuators 42 and/or 44. Consequently, both displacement units 48*a* and 48*b* can be connected to the third conduit system 62 by appropriately actuating the valves 64 and 66. The third conduit system 62 and its connection to the high and low pressure conduit systems 58 and 60 provides the system 40 with the ability to recapture energy (fluid pressure and/or flow) from either actuator 42 and 44 operating with an assistive load, and transfer energy to either actuator 42 and 44 operating under a resistive load. For example, the second displacement unit 48*b* can be operated in its pumping mode to supply extra flow into the third circuit system 62 if the assistive load derived from one of the actuators 42 or 44 is insufficient for the demands of the resistive load at the other actuator 42 or 44. The second displacement unit 48*b* can also be used to recover energy from assistive loads by operating the valve sets 50, 52, 54 and/or 56 to cause fluid from either actuator 42 or 44 with an assistive load to be routed to the reservoir 68 through the second displacement unit 48*b*, causing the unit 48*b* to operate in its motoring mode.

Figure 4:
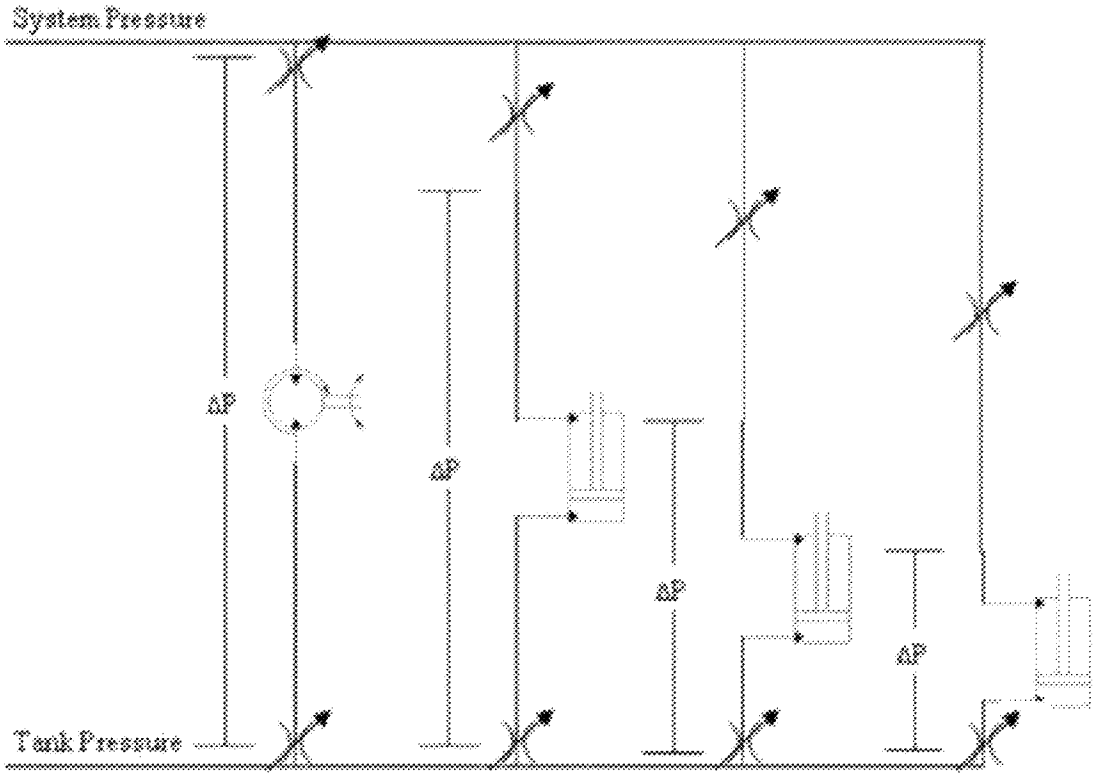
FIG. 4 is a diagram representing a conventional load-sensing system of a prior art hydraulic system, and represents one actuator of the system as requiring a higher pressure for its current operation than other actuators within the system.
Figure 5:
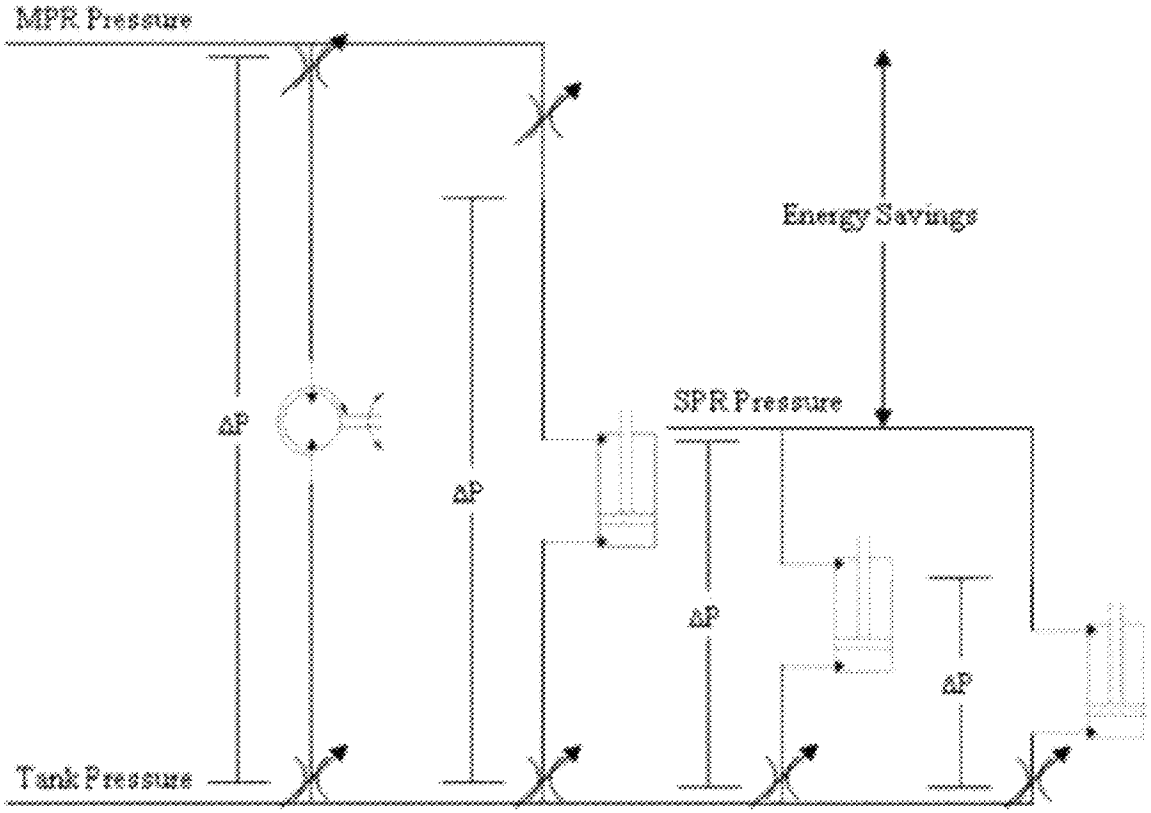
FIG. 5 is a diagram representing a two-load sensing capability provided with the hydraulic system of FIG. 3, and represents one actuator of the system as requiring a higher pressure for its current operation than other actuators within the system.

The system 40 of FIG. 3 provides the ability for flow regeneration, but in the event that all the loads on the system 40 are resistive, the third conduit system 62 also allows the resistive loads to be separated into groups. For example, the actuators 42 and 44 can be reconfigured with the valve sets 50, 52, 54 and 56 and valves 64 and 66 into two separate ("split") load-sensing systems, as represented in FIG. 5. This approach becomes advantageous when there are one or more actuators that require a higher pressure at a point in its operation, and one or more other actuators that only require a lower pressure at some point in its operation. FIGS. 4 and 5 are diagrams of a conventional load-sensing system and the split load-sensing system, respectively, operating under such conditions, in which three actuators are operated under a relatively high pressure (approaching the system pressure produced by the displacement unit 48*a*), a relatively low pressure (approaching the tank pressure of the reservoir 68), or some intermediate pressure. By comparing FIGS. 4 and 5, it can be seen that the split load-sensing system of this invention minimizes the amount of power that is lost within the system 40 by avoiding the power loss that would otherwise occur as a result of the need to operate control valves (for example, the valves of the valve sets 50, 52, 54 and 56 of FIG. 3) to meter flow to the actuators operating at the lower pressures, resulting in reduced efficiency and heat generation. Specifically, the split load-sensing system provided by the system 40 of FIG. 3 operates as a single conventional load-sensing system using a high pressure conduit (conduit system 58) for a hydraulic actuator requiring a pressure higher than the remaining two actuators, and a second independent, load-sensing system using a second positive displacement unit (not shown) connected to an intermediate pressure conduit (conduit system 62) for the two actuators in FIG. 5 that require a smaller pressure than the first actuator.

Figure 6:
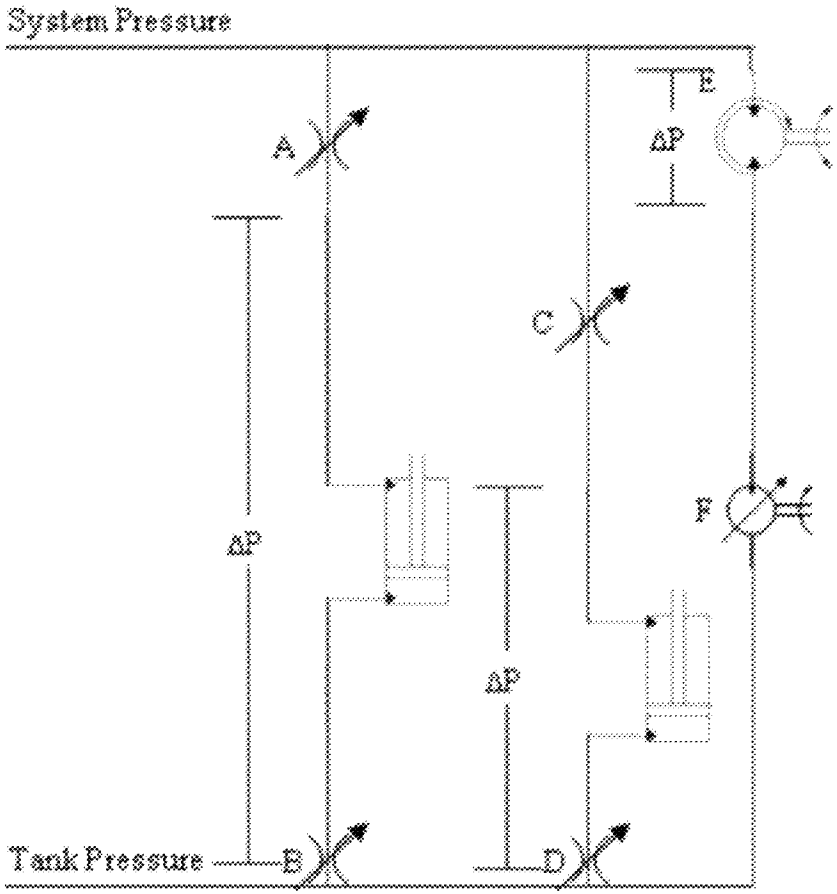
FIG. 6 is a diagram representing an energy recovery flow control (ERFC) mode of the hydraulic system of FIG. 3.

The system 40 also allows efficiency improvements even if all actuators in the system 40 have resistive loads and are requesting very high pressures, as well as situations in which all but one actuator in the system 40 have a resistive load requiring high pressure. In a traditional load-sensing system, a control valve would be employed to meter the flow to the low-pressure actuator to achieve this difference in pressure, but with the undesirable consequences of reducing efficiency and generating heat. With the system 40 of FIG. 3, a separate load-sensing system could be established with the third conduit system 62 (similar to FIG. 5), or the third conduit system 62 could be used to allow the low-pressure actuator to operate in an energy recovery flow control (ERFC) configuration. FIG. 6 is representative of an ERFC configuration in which, for example, the inlet 78*a* of the actuator 42 is connected with the first valve (1) of the first valve set 50 to high pressure from the first displacement unit 48*a*, and the other port 78*b* of the actuator 42 is connected to the second displacement unit 48*b* via the third conduit system 62. The unit 48*b* operates in its motoring mode to control the pressure drop and flow of the actuator 42, and in this manner the unit 48*b* is able to recover the energy that would otherwise be lost through metering flow with control valves in a conventional hydraulic system. The pressure drops "A" and "C" are caused by throttling flow through, for example, the first valves (1) of the valve sets 52 and 56, while much lower pressure drops "B," "D" and "E" are the result of wide-open valves (in the case of E, represented as a hydraulic motor). On the other hand, the pressure drop "F" is caused by the displacement unit 48*b* acting as a motor and controlling the amount of back pressure on the hydraulic motor. Though the ERFC configuration results in efficiency losses in the displacement unit 48*b*, a significant amount of energy is recovered that would typically be completely lost by metering over a valve.

As known in the art, displacement control can be very efficient if displacement units (pumps/motors) are operated at high displacements. However, when subjected to relatively low pressures the units have lower displacements and lower efficiencies. This design tradeoff can be minimized by modifying the system 40 of FIG. 3 in a manner shown in FIG. 7. The hydraulic system 40 of FIG. 7 differs from that of FIG. 3 by the inclusion of multiple additional displacement units 48*c* and 48*d* driven by the motor 46 as described previously for the units 48*a* and 48*b*. As with the unit 48*b*, the additional units 48*c* and 48*d* are shown as being coupled to the third conduit system 62. Furthermore, each unit 48*c* and 48*d* is represented as having a different maximum displacement than the displacement unit 48*b*. By selecting which unit 48*b*, 48*c* and 48*d* to operate based on the displacement of each, the unit or units having the highest efficiency at a given pressure and flow rate can be selected for operation within the system 40 of FIG. 7. In this manner, the system 40 is able to maximize the amount of energy recovered by operating each unit 48*a*, 48*b* and 48*c* near its optimal operating point (typically at displacements near maximum). Though the inclusion of the additional units 48*c* and 48*d* will tend to increase costs and parasitic losses from churning and friction, churning losses can be reduced by adding a clutch 49 to each unit 48*b*, 48*c* and 48*d* to disconnect them from the system 40 when they are not being used. By preventing the operation of the units 48*c* and 48*d*, the system 40 is functional and operatively identical to the system 40 of FIG. 3.

Figure 7:
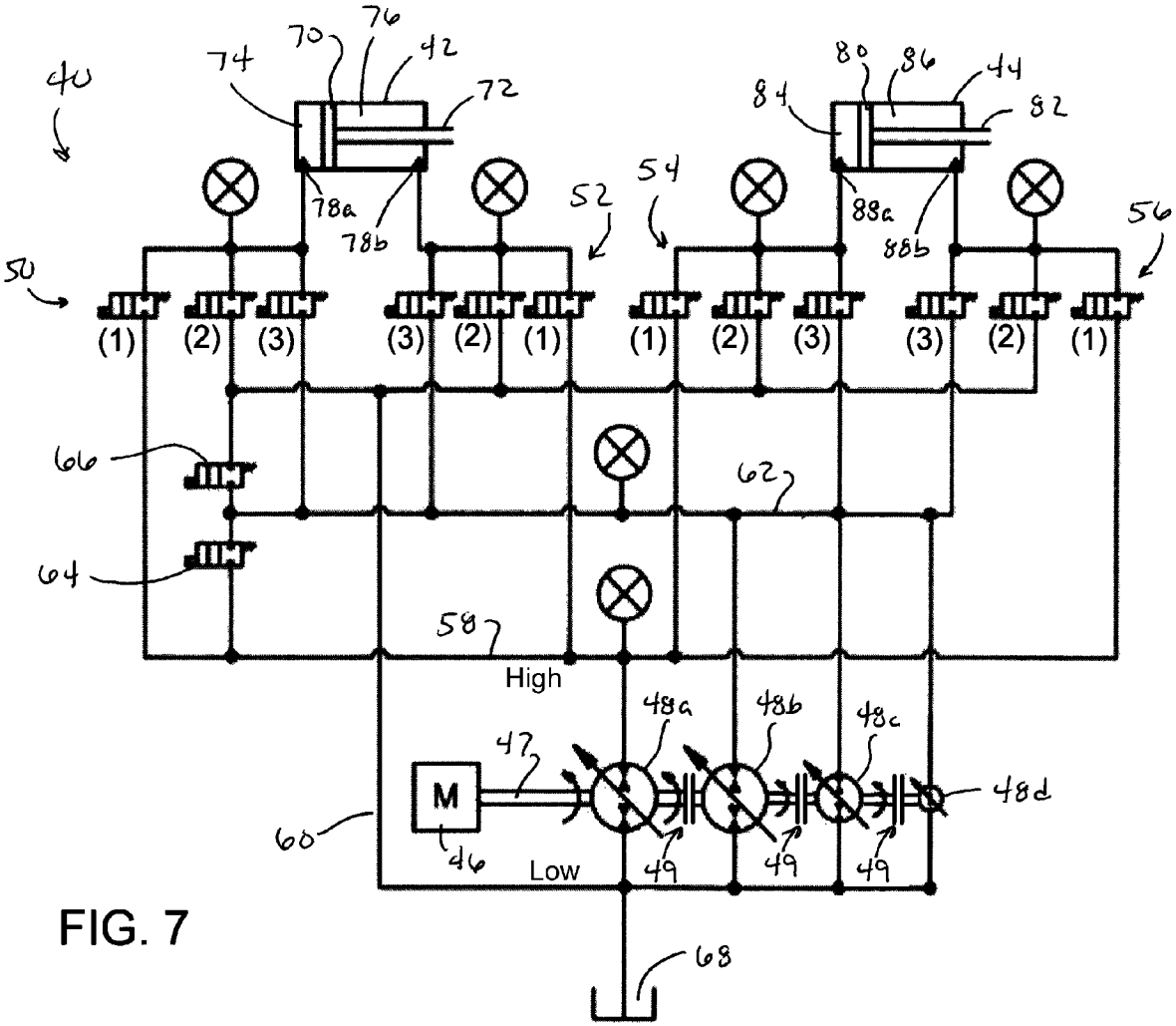
FIGS. 7 and 8 schematically represent hydraulic systems configured to have energy recovery capabilities in accordance with second and third embodiments of the present invention.

The systems 40 represented in FIGS. 3 and 7 are based on a concept of recovering energy from assistive loads without necessarily or always transferring the energy to a common shaft 47 or accumulator (not shown). Accomplishing this over a wide range of pressure/flow relationships, however, typically requires the additional displacement units 48*b*, 48*c* and 48*d* as shown in FIGS. 3 and 7. There may be cases where space isn't available to add extra units, or profit margins and the target market are unable to justify the extra cost. In these situations, it would be beneficial to convert hydraulic power directly from one pressure to another pressure (higher or lower) without using a pump/motor. Researchers have considered the idea of a hydraulic transformer borrowed from electronics. In their simplest sense, hydraulic transformers may take in a fluid at one hydraulic pressure and flow rate and output the fluid at a lower pressure and higher flow rate (buck mode), or output the fluid at a higher pressure and lower flow rate (boost mode). Hydraulic transformers typically operate in either a buck mode or a boost mode. Under some operating conditions researchers have achieved efficient pressure reduction (buck mode), though current efforts appear to be focused on pressure amplification (boost mode). Without losses the amount of power into and out of a hydraulic transformer remains constant, but efficiencies tend to vary depending on operating conditions and component dynamics due to compressibility and metering losses. In a switching-type hydraulic transformer capable of operating in both buck and boost modes, these modes rely on the inductive (inertial) properties of the fluid but the capacitive or compressibility aspects of hydraulic fluid tend to dominate.

Figure 8:
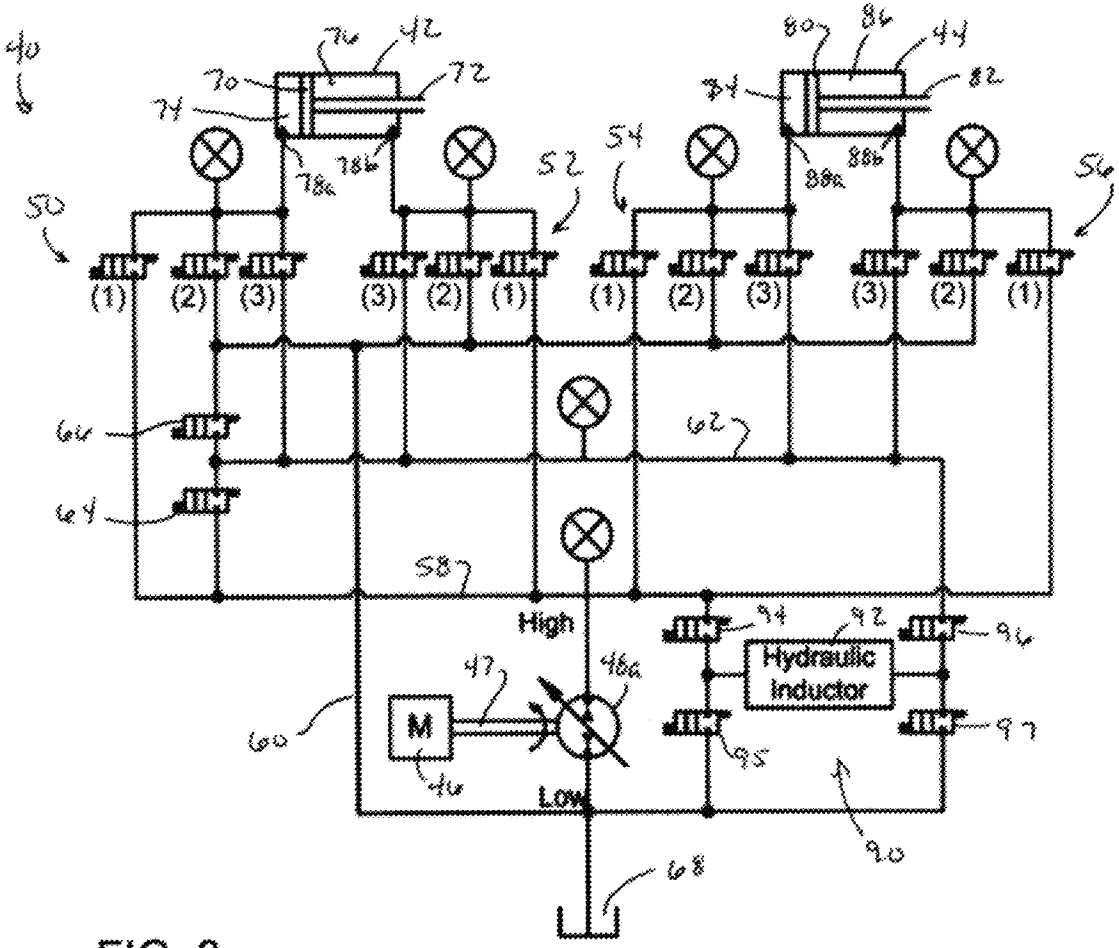

With the use of an appropriate hydraulic transformer, another modification of the hydraulic system 40 of FIG. 3 becomes possible, as shown in FIG. 8. The system 40 of FIG. 8 allows energy at one pressure to be recovered from an actuator with an assistive load and used again by the third conduit system 62 at a different pressure (power recovery minus losses remains constant) without requiring the second or additional variable displacement units 48*b*, 48*c* and 48*d* of the embodiments shown in FIGS. 3 and 7. Instead, the system 40 of FIG. 8, while similar to that of FIG. 3, includes a hydraulic transformer 90 having at least two ports between the high pressure and third conduit systems 58 and 62, where pressure and flow can be exchanged at different levels. The transformer 90 is shown as comprising a hydraulic inductor 92 having a first port connected by a pair of valves 94 and 95 to the high and low pressure conduit systems 58 and 60, and a second port connected by a pair of valves 96 and 97 to the low pressure and third conduit systems 60 and 62. It is foreseeable that other forms of hydraulic transformers, both known and developed in the future, could be substituted for the transformer 90 represented in FIG. 8.

Inherent in the systems 40 of FIGS. 3, 7 and 8 is the ability to reconfigure the hydraulic systems 40 in the event of component failure. If a displacement unit or valve fails and the electronic control system used to control the valve sets 50, 52, 54 and 56 is configured to detect such failures, the operation of the valves can be reconfigured to bypass the failed component and safely complete a task performed with either or both actuators 42 and 44. This mode will typically result in reduced efficiency and performance, but by isolating the failure, fluid leaks can usually be stopped and basic machine functionality maintained until maintenance can be performed.

Figure 1:
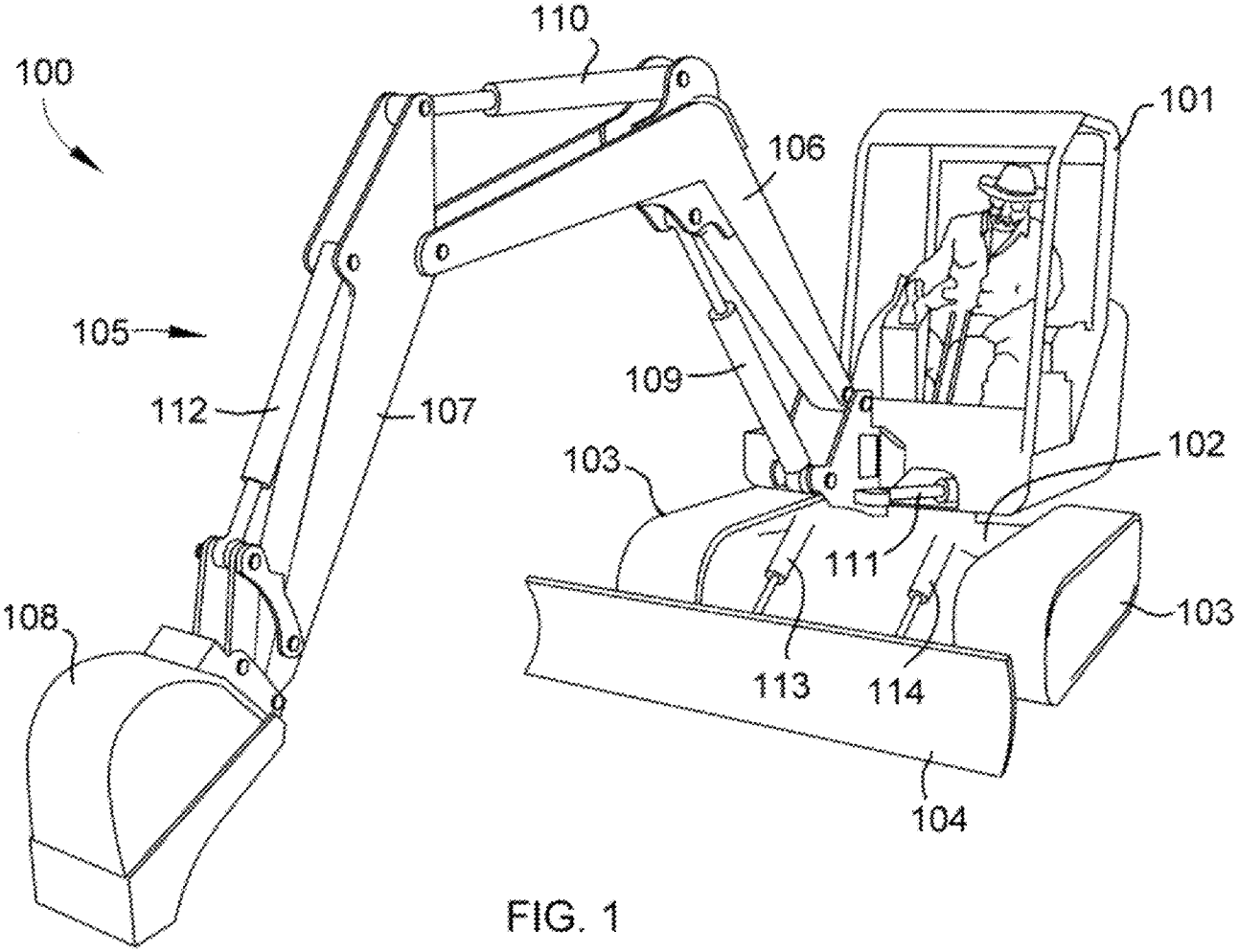
FIG. 1 schematically represents a compact excavator of a type known in the prior art.

As previously noted, the systems 40 of FIGS. 3, 7 and 8 can be used in a wide variety of applications, including the operation of the implements of the excavator 100 shown in FIG. 1. Hydraulic excavators of the type represented in FIG. 1 are a good platform for implementing the systems 40 because their various and multiple implements (such as the tracks 103, blade 104, boom 106, stick 107, and attachment 108) will typically make many movements at the same time, with both assistive and resistive loads on the actuators 109-114. For example when the excavator 100 is preparing to dig, the boom cylinder 109 is retracted with an assistive load and the stick cylinder 110 retracts with a resistive load. In a conventional hydraulic system, the energy available from retracting the boom cylinder 109 would be dissipated over a metering orifice of a valve. With one of the systems 40 of the present invention, some of this potential energy can be recovered from the boom cylinder 109 and rerouted with the third conduit unit 62 to power the stick cylinder 110. With the systems 40, the power contribution of the excavator's engine (not shown) could be minimal during this combination of boom and stick motions, leading to reduced fuel costs and helping to offset the increased system cost due to the extra valves of the systems 40.

Another application that would benefit from one of the systems 40 of FIGS. 3, 7 and 8 is a tracked feller-buncher as used in the logging industry. A feller-buncher is a machine typically equipped with a large diameter saw blade that is used to cut down trees and place them into piles to be hauled off for processing. A feller-buncher operator often makes many simultaneous movements with a boom and stick, leveling the head, and tracking the machine with the saw running. At any one time there are typically multiple actuators with either assistive or resistive loads. Since a feller-buncher is often operated to move a tree's center of mass from a higher elevation to a lower one, significant energy savings may be realized by recovering this energy and using it for other resistive actuator motions. In this manner, the systems 40 have the capability of reducing the engine size required, recovering energy when possible, and saving fuel during operation. Because of the reconfigurable capabilities and redundant flow paths, aerospace flight control systems and other mission-critical applications are also possible applications for the systems 40.

From the above it can be appreciated that, while valves are common components in many hydraulic systems, they are typically used as metering devices to control power delivery to an actuator by dissipating excess energy through an orifice. By using multiple valves as logic devices with displacement control units as discussed above, hydraulic systems 40 capable of higher performance energy-efficient hydraulic systems are made possible. With the addition of embedded distributed controllers and intelligent decision-making machine level algorithms, these systems 40 can provide new levels of machine performance, reliability, and safety.

While the invention has been described in terms of specific embodiments, it is apparent that other forms could be adopted by one skilled in the art. For example, the physical configurations of the systems 40 could differ from those shown. Therefore, the scope of the invention is to be limited only by the following claims.

The invention claimed is:

1. A hydraulic system comprising:

at least first and second hydraulic actuators;

multiple sets of hydraulic valves fluidically connected to the first and second hydraulic actuators;

at least first and second variable displacement units each having pumping and motoring modes;

drive shafts associated with the first and second variable displacement units and interconnected with each other such that the drive shafts are rotatably coupled and cause the first and second variable displacement units to operate in unison;

at least one motor connected to the drive shafts of the variable displacement units for rotating the drive shafts;

at least one reservoir from which the fluid can be drawn by the first and second variable displacement units when operating in their pumping modes and to which the fluid can be returned by the first and second variable displacement units when operating in their motoring modes;

a first conduit system containing at least a first hydraulic valve of each of the sets of hydraulic valves, the first conduit system selectively fluidically connecting the first variable displacement unit to the first and second hydraulic actuators, each of the first hydraulic valves selectively fluidically connecting the first variable displacement unit to one of the first or second hydraulic actuators;

a second conduit system containing at least a second hydraulic valve of each of the sets of hydraulic valves, the second conduit system selectively fluidically connecting the first and second hydraulic actuators to the reservoir, each of the second hydraulic valves selectively fluidically connecting one of the first or second hydraulic actuators to the reservoir;

a third conduit system containing at least a third hydraulic valve of each of the sets of hydraulic valves, the third conduit system selectively fluidically connecting at least the second variable displacement unit to the first and second hydraulic actuators, each of the third hydraulic valves selectively fluidically connecting the second variable displacement unit to one of the first or second hydraulic actuators, the third conduit system being adapted to transfer the fluid between the first and second hydraulic actuators;

first valve means for selectively fluidically isolating the first conduit system from the third conduit system and selectively fluidically connecting the first conduit system to the third conduit system; and second valve means for selectively fluidically isolating the second conduit system from the third conduit system and selectively fluidically connecting the second conduit system to the third conduit system;

wherein the hydraulic system is operable to:

transfer energy when one of the first and second hydraulic actuators is subjected to a resistive load and the other of the first and second hydraulic actuators is subjected to an assistive load by transferring the fluid within the other of the first and second hydraulic actuators to the one of the first and second hydraulic actuators through the third conduit system;

transfer energy when one of the first and second hydraulic actuators is subjected to a resistive load and the other of the first and second hydraulic actuators is subjected to an assistive load by transferring the fluid from the reservoir to the one of the first and second hydraulic actuators through the third conduit system while operating the second variable displacement unit in the pumping mode thereof; and recover energy when one of the first and second hydraulic actuators is subjected to an assistive load by transferring the fluid within the one of the first and second hydraulic actuators to the reservoir through the third conduit system while operating the second variable displacement unit in the motoring mode thereof.

2. The hydraulic system according to claim 1, further comprising at least a third variable displacement unit having pumping and motoring modes, the third variable displacement unit being fluidically connected to the third conduit system and being rotatably coupled to the second variable displacement unit to cause the second and third variable displacement units to operate in unison.

3. The hydraulic system according to claim 2, wherein the third variable displacement unit has a different maximum displacement than the second variable displacement unit.

4. The hydraulic system according to claim 2, wherein the second and third variable displacement units are rotatably coupled to each other through a clutch or transmission.

5. The hydraulic system according to claim 1, wherein the first and second hydraulic actuators are linear or rotary actuators.

6. The hydraulic system according to claim 1, wherein the third conduit system, the multiple sets of hydraulic valves, and the first and second valve means are operable to separate the first and second hydraulic actuators into different load-sensing systems.

7. The hydraulic system according to claim 1, wherein the hydraulic system is installed on machinery comprising a plurality of implements, and the first and second hydraulic actuators are operatively coupled to the implements for moving the implements.

8. A hydraulic system comprising:

at least first and second hydraulic actuators, each of the first and second hydraulic actuators having first and second chambers fluidically connected to first and second ports, respectively;

at least first and second sets of hydraulic valves fluidically connected to the first hydraulic actuator, the first set of hydraulic valves being fluidically connected to the first port of the first hydraulic actuator, and the second set of hydraulic valves being fluidically connected to the second port of the first hydraulic actuator;

at least third and fourth sets of hydraulic valves fluidically connected to the second hydraulic actuator, the third set of hydraulic valves being fluidically connected to the first port of the second hydraulic actuator and the fourth set of hydraulic valves being fluidically connected to the second port of the second hydraulic actuator;

a plurality of variable displacement units each having pumping and motoring modes;

drive shafts associated with the variable displacement units and interconnected with each other such that the drive shafts are rotatably coupled and cause the variable displacement units to operate in unison;

at least one motor connected to the drive shafts of the variable displacement units for rotating the drive shafts;

at least one reservoir from which the fluid can be drawn by the variable displacement units when operating in their pumping modes and to which the fluid can be returned by the variable displacement units when operating in their motoring modes;

a first conduit system containing at least a first hydraulic valve of each of the first, second, third and fourth sets of hydraulic valves, the first conduit system selectively fluidically connecting a first of the variable displacement units to the first and second hydraulic actuators, each of the first hydraulic valves selectively fluidically connecting the first of the variable displacement units to one of the first or second hydraulic actuators;

a second conduit system containing at least a second hydraulic valve of each of the first, second, third and fourth sets of hydraulic valves, the second conduit system selectively fluidically connecting the first and second hydraulic actuators to the reservoir, each of the second hydraulic valves selectively fluidically connecting one of the first or second hydraulic actuators to the reservoir;

a third conduit system containing at least a third hydraulic valve of each of the first, second, third and fourth sets of hydraulic valves, the third conduit system selectively fluidically connecting a second of the variable displacement units to the first and second hydraulic actuators, each of the third hydraulic valves selectively fluidically connecting the second of the variable displacement units to one of the first or second hydraulic actuators, the third conduit system being adapted to transfer the fluid between the first and second hydraulic actuators;

first valve means for selectively fluidically isolating the first conduit system from the third conduit system and selectively fluidically connecting the first conduit system to the third conduit system; and second valve means for selectively fluidically isolating the second conduit system from the third conduit system and selectively fluidically connecting the second conduit system to the third conduit system;

wherein the hydraulic system is operable to:

transfer energy when one of the first and second hydraulic actuators is subjected to a resistive load and the other of the first and second hydraulic actuators is subjected to an assistive load by transferring the fluid within the other of the first and second hydraulic actuators to the one of the first and second hydraulic actuators through the third conduit system;

transfer energy when one of the first and second hydraulic actuators is subjected to a resistive load and the other of the first and second hydraulic actuators is subjected to an assistive load by transferring the fluid from the reservoir to the one of the first and second hydraulic actuators through the third conduit system while operating the second of the variable displacement units in the pumping mode thereof; and recover energy when one of the first and second hydraulic actuators is subjected to an assistive load by transferring the fluid within the one of the first and second hydraulic actuators to the reservoir through the third conduit system while operating the second of the variable displacement units in the motoring mode thereof.

* * * * *